US005320090A

United States Patent [19]

Carpenter

[11] Patent Number: 5,320,090

[45] Date of Patent: Jun. 14, 1994

[54] BLOWER APPARATUS FOR GAS HEATED LOGS

[76] Inventor: Jack L. Carpenter, Rte. 2, Box 194, Spring Hope, N.C. 27882

[21] Appl. No.: 952,318

[22] Filed: Sep. 28, 1992

[51] Int. Cl.[5] ..... F24C 3/00

[52] U.S. Cl. ..... 126/512; 126/502; 126/508

[58] Field of Search ..... 126/512, 502, 503, 113, 126/92 R, 508, 95, 96; 431/125

[56] References Cited

U.S. PATENT DOCUMENTS

| | | | |
|---|---|---|---|
| 4,336,790 | 6/1982 | Bartsch | 126/508 |
| 4,381,759 | 5/1983 | Faustini | 126/502 |
| 4,432,337 | 2/1984 | Gregory | 126/512 |
| 4,502,463 | 3/1985 | Gregory | 126/512 |

*Primary Examiner*—4
*Assistant Examiner*—James C. Yeung
*Attorney, Agent, or Firm*—Leon Gilden

[57] ABSTRACT

A blower assembly includes a first tubular duct in pneumatic communication with a second tubular duct arranged in a generally oblique orientation relative to one another. A thermostatic switch effects actuation of a plurality of blower fans mounted at an entrance opening at a lower distal end of the first tubular duct to direct heat through the first and second tubular ducts. V-shaped spring plates mounted within side walls of the first tubular duct receive the respective first and second legs of a base assembly mounting the logs to be heated. An optional moisturizing and deodorizing dispenser assembly is mounted to the second tubular duct structure for dispersion throughout a room environment.

2 Claims, 4 Drawing Sheets

BLOWER APPARATUS FOR GAS HEATED LOGS

BACKGROUND OF THE INVENTION

1. Field of the Invention

The field of invention relates to heat directing apparatus, and more particularly pertains to a new and improved blower apparatus for gas heated logs to direct heat relative to a room in an environment typically utilizing gas heated logs.

2. Description of the Prior Art

The use of gas fired logs is conventionally utilized where individuals are not availed of suitable fire wood for heating purposes or are indifferent to the requirement to clean and maintain such conventional fireplace structure. Heat exchanger apparatus has been availed in the prior art to direct heat relative to a room environment such as indicated in the U.S. Pat. Nos. 4,332,236; 4,381,759; 4,928,667; and 4,078,542.

The prior art has heretofore been typically arranged relative to conventional fireplaces to position blowers and the like in a spaced orientation relative to such log structure to be heated. The instant invention is arranged for cooperation with gas fired logs, wherein heat is to be directed into the duct work as set forth by the instant invention to maximize heat to be directed into a room environment.

SUMMARY OF THE INVENTION

In view of the foregoing disadvantages inherent in the known types of heat exchanger structure now present in the prior art, the present invention provides a blower apparatus for gas heated logs wherein the same is arranged to position blower motors in adjacency relative to the log members. As such, the general purpose of the present invention, which will be described subsequently in greater detail, is to provide a new and improved blower apparatus for gas heated logs which has all the advantages of the prior art heat exchanger apparatus and none of the disadvantages.

To attain this, the present invention provides a blower assembly including a first tubular duct in pneumatic communication with a second tubular duct arranged in a generally oblique orientation relative to one another. A thermostatic switch effects actuation of a plurality of blower fans mounted at an entrance opening at a lower distal end of the first tubular duct to direct heat through the first and second tubular ducts. V-shaped spring plates mounted within side walls of the first tubular duct receive the respective first and second legs of a base assembly mounting the logs to be heated. An optional moisturizing and deodorizing dispenser assembly is mounted to the second tubular duct structure for dispersion throughout a room environment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved blower apparatus for gas heated logs which has all the advantages of the prior art heat exchanger apparatus and none of the disadvantages.

It is another object of the present invention to provide a new and improved blower apparatus for gas heated logs which may be easily and efficiently manufactured and marketed.

It is a further object of the present invention to provide a new and improved blower apparatus for gas heated logs which is of a durable and reliable construction.

An even further object of the present invention is to provide a new and improved blower apparatus for gas heated logs which is susceptible of a low cost of manufacture with regard to both materials and labor, and which accordingly is then susceptible of low prices of sale to the consuming public, thereby making such blower apparatus for gas heated logs economically available to the buying public.

Still yet another object of the present invention is to provide a new and improved blower apparatus for gas heated logs which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
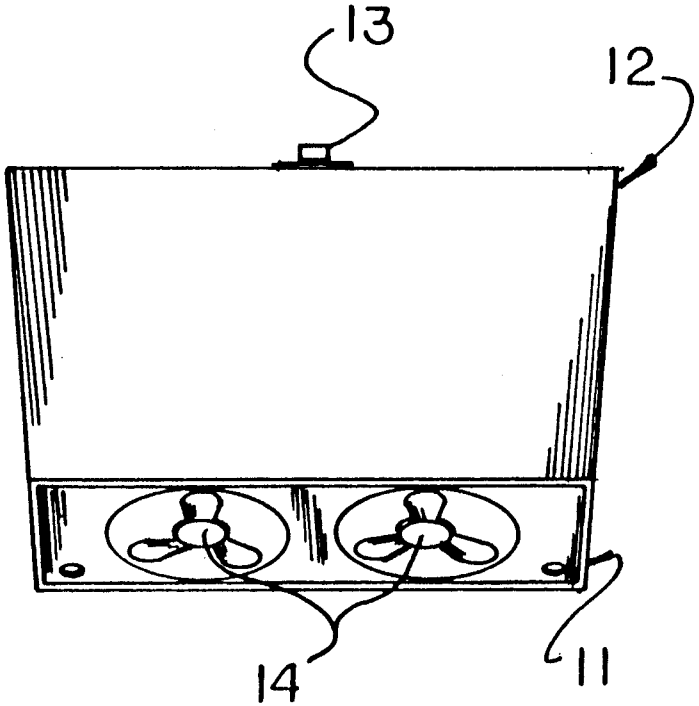
FIG. 2 is an orthographic bottom view of the invention.
Figure 1:
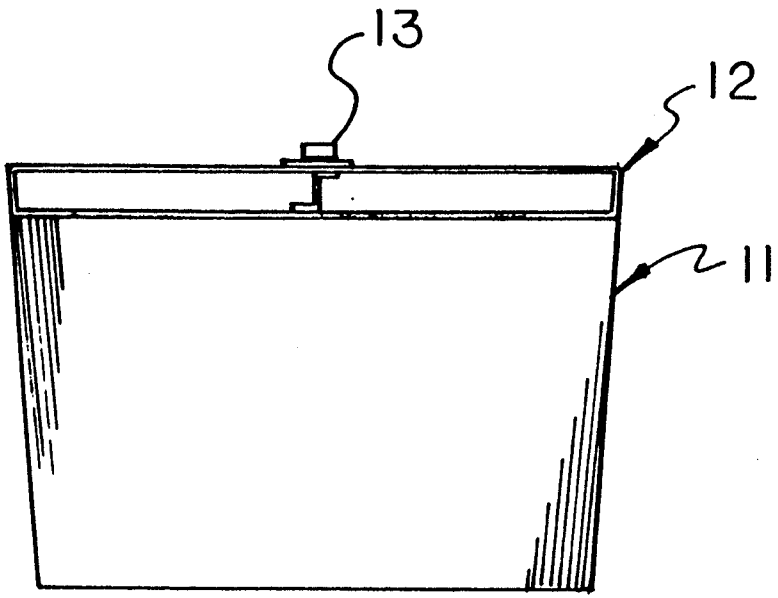
FIG. 1 is an orthographic frontal view, taken in elevation, of the invention.
Figure 3:
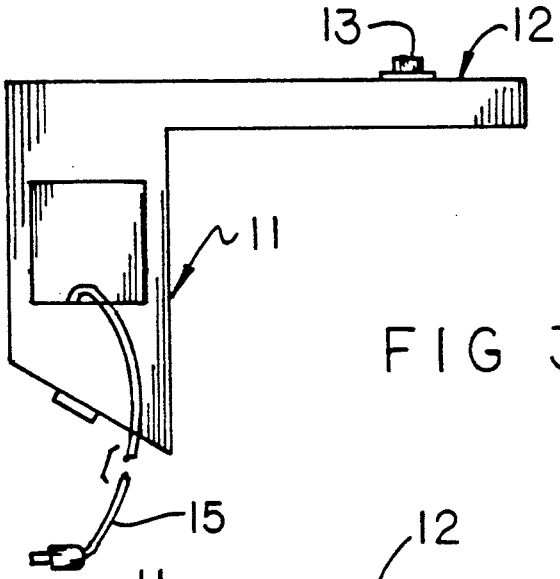
FIG. 3 is an orthographic side view of the invention.
Figure 4:
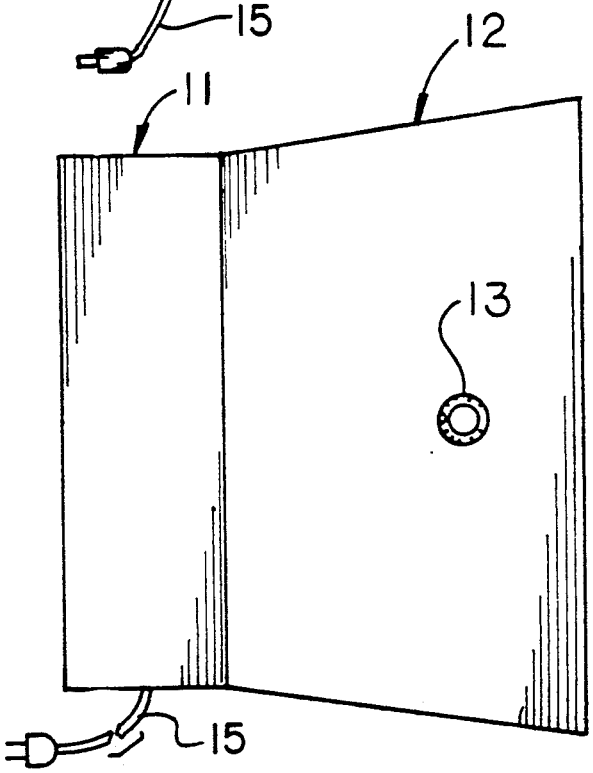
FIG. 4 is an orthographic top view of the invention.
Figure 5:
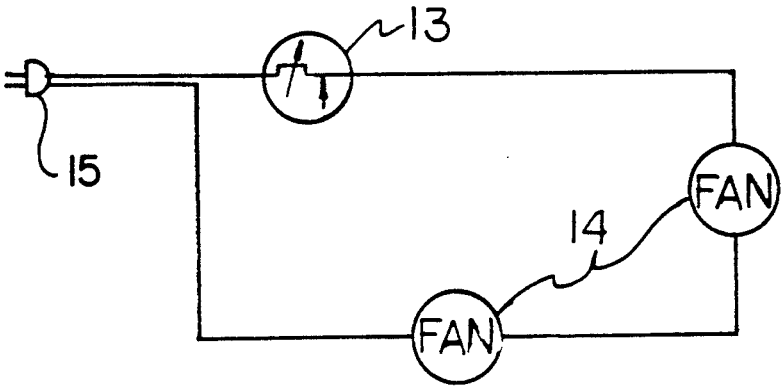
FIG. 5 is a diagrammatic illustration of the fan motors as utilized by the invention in electrical communication with the thermostatic switch.

With reference now to the drawings, and in particular to FIGS. 1 to 9 thereof, a new and improved blower apparatus for gas heated logs embodying the principles and concepts of the present invention and generally designated by the reference numeral 10 will be described.

Figures 6, 7:
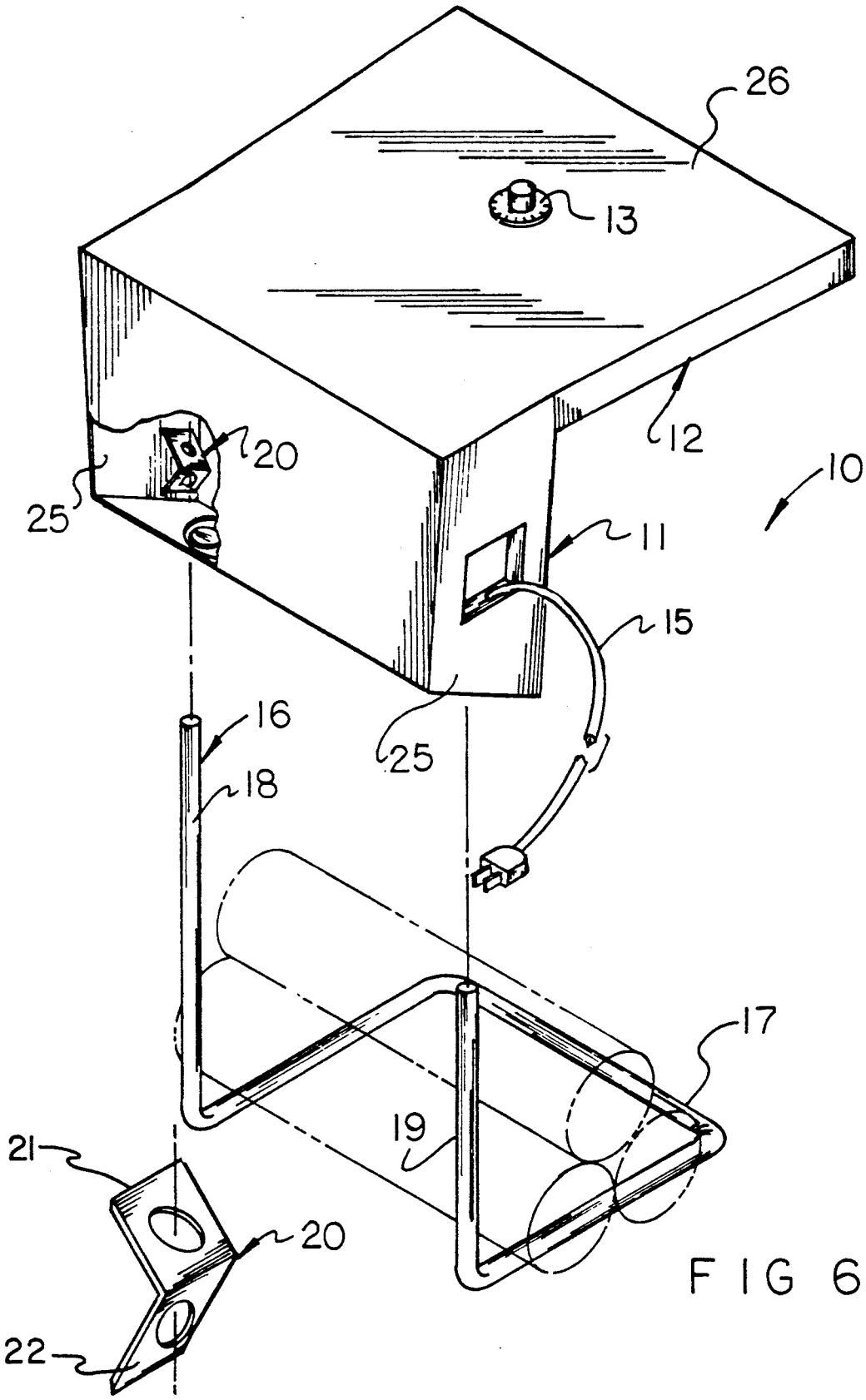
FIG. 6 is an isometric illustration of the invention in an exploded illustration.
FIG. 7 is an enlarged isometric illustrated of a spring plate as utilized by the invention.

More specifically, a first tubular duct 11 is arranged in pneumatic communication with a second tubular duct 12 at an oblique orientation relative to one another. A thermostatic switch 13 is mounted within the second tubular duct, where it is understand that the sensor structure for the thermostatic switch 13 may be in fact mounted within the first tubular duct as desired. Such thermostatic switches per se are conventional and their details are not believed to be required to one of ordinary skill in the art. A plurality of blower fans 14 are mounted within the first tubular duct 11 at the lower distal end of the first tubular duct at its entrance opening spaced from the second tubular duct. Upon adequate temperature being sensed by the thermostatic switch 13, the blower fans 14 are actuated through the electrical power supply 15 to direct heated air through the duct work structure from log members, as illustrated in phantom in FIG. 6, mounted upon an associated log support frame 16. The log support frame 16 includes a U-shaped base 17 having a first leg 18 and a second leg 19 respectively orthogonally mounted to the U-shaped frame 17, wherein the first and second legs 18 and 19 are arranged orthogonally relative to the U-shaped base 17 in a parallel coextensive relationship relative to one another. The first tubular duct 11 includes first duct side walls 25, with each first duct side wall 25 having a V-shaped spring plate 20. Each V-shaped spring plate 20, as indicated in FIG. 7, includes a first plate 21 mounted to a second plate 22, with the first plate 21 having a first opening, the second plate 22 having a second opening. The first and second openings 23 and 24 respectively are aligned relative to one another and canted relative to one another to frictionally receive and engage a leg member of the first and second legs 18 and 19 of the log support frame 16 to permit vertical adjustment of the first and second tubular ducts 11 and 12 relative to the log support frame 16.

Figure 8:
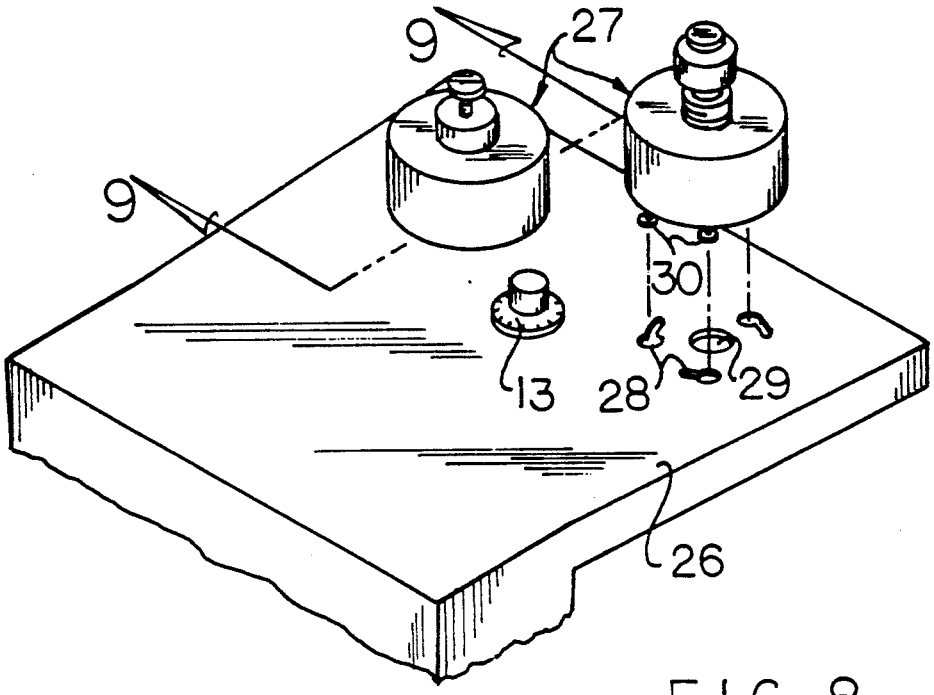
FIG. 8 is a partial isometric illustration of the second duct structure mounting fluid reservoirs thereon.
Figure 9:
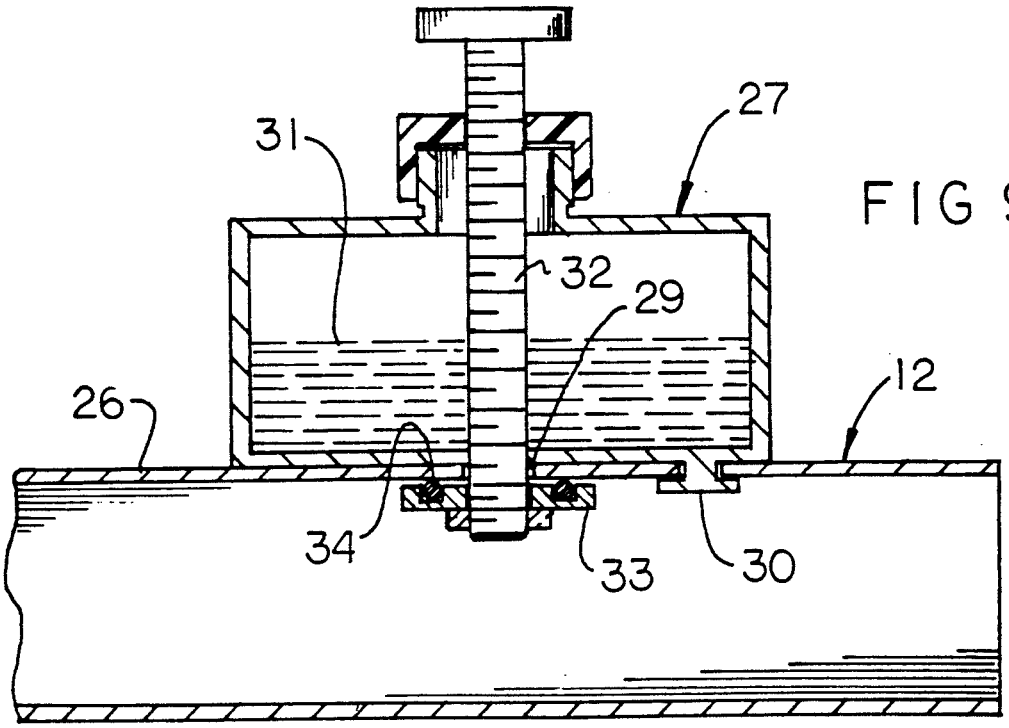
FIG. 9 is an orthographic view, taken along the lines 9—9 of FIG. 8 in the direction indicated by the arrows.

As illustrated in the FIG. 8, the second tubular duct 12 includes a second tubular duct top wall 26 mounting at least, and preferably a plurality, of fluid dispensing reservoirs 27. The reservoirs may contain moisturizing agents for humidification of a room environment and additionally a scented fluid within one of the reservoirs to direct a scented mixture such as pine scent through a room environment to simulate burning of cellular logs. To accommodate each reservoir, an annular array of keyhole openings 28 are mounted through the top wall 26, with a central opening 29 having a first diameter oriented medially of the concentric array of keyhole openings 28. To mount the reservoir, the reservoir bottom wall includes a plurality of reservoir legs 30 directed through the keyhole openings 29 to secure the reservoir relative to the top wall 26. Each reservoir includes a reservoir fluid 31 therewithin. An externally threaded screw dispenser 32 is directed through the reservoir and through the bottom wall of the reservoir and directed through the central opening 29 within the second tubular duct 12, as indicated in FIG. 9. The screw dispenser 32 permits fluid 31 to be directed into the second tubular duct 12 about the screw threads. To discontinue fluid flow into the second tubular duct, a seal plate 33 is provided, with the seal plate 33 of a second diameter greater than the first diameter, and is threadedly secured onto the lower distal end portion of the screw dispenser 32 subsequent to positioning of the reservoir onto the top wall 26. The seal plate 33 includes an "O" ring 34 to extend beyond the central opening 29, whereupon subsequent to securing the seal plate 33 to the screw dispenser 32, the screw dispenser upon being withdrawn from the second tubular duct effects engagement of the "O" ring 34 in surrounding relationship relative to the opening 29 to permit further dispensing of fluid therethrough into the second tubular duct.

It should be further noted to effect reciprocation of the screw dispenser 32 relative to the reservoir 27, the reservoir top wall having a cap mounted thereto, with the screw dispenser threadedly directed orthogonally to the cap to permit reciprocation of the seal plate relative to an interior surface of the top wall 26 relative to the second tubular duct to effect selective engagement of the "O" ring 34 relative to the interior surface of the top wall to effect selective sealing of the "O" ring relative to the top wall permitting selective fluid flow along the screw dispenser when the seal plate, and more particularly the "O" ring 34, is spaced from the top wall.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A blower apparatus for gas heated logs, comprising, a first tubular duct mounted to a second tubular duct, with the first tubular duct arranged in pneumatic communication with the second tubular duct, the first tubular duct includes an entrance opening spaced from the second tubular duct, and the entrance opening including a plurality of blower fans mounted therewithin, and a thermostatic switch mounted to the second tubular duct, an electrical power supply directed to the thermostatic switch and to the blower fans to effect selective actuation of the blower fans upon attaining a predetermined temperature regulated by the thermostatic switch, and a log support frame, the log support frame including a U-shaped base, the U-shaped base arranged for receiving gas fired logs thereon, the U-shaped base including a first leg fixedly and orthogonally mounted to the U-shaped base, and a second leg fixedly and orthogonally mounted to the U-shaped base, with the first leg and the second leg arranged in a parallel coextensive relationship relative to one another, and the first tubular duct includes spaced side walls, wherein each side wall includes a V-shaped spring plate, each V-shaped spring plate receives a leg of said first leg and said second leg, and each V-shaped spring plate fixedly mounted within the first tubular duct to one of said side walls, and each V-shaped spring plate includes a first plate mounted fixedly to a second plate, with the first plate canted relative to the second plate, the first plate having a first opening, the second plate having a second opening, the first opening and second opening are aligned relative to one another to frictionally engage and receive said leg, and the second tubular duct includes a top wall spaced from the entrance opening, and the top wall includes at least one fluid dispensing reservoir, the top wall having a plurality of keyhole openings arranged in an annular array and a central opening positioned medially of the keyhole openings, and the reservoir having a reservoir bottom wall, and the reservoir including an externally threaded screw dispenser orthogonally through the bottom wall, and a seal plate mounted to the screw dispenser within the second tubular duct, with the top wall positioned between the seal plate and the reservoir, the seal plate having an "O" ring, the central opening having a first diameter, the "O" ring having a second diameter greater than the first diameter, wherein the screw dispenser is arranged for threaded reciprocation relative to said top wall to effect selective engagement of the "O" ring relative to the top wall within the second tubular duct.

2. An apparatus as set forth in claim 1 wherein the reservoir includes a reservoir top wall, the reservoir top wall including a cap, the screw dispenser threaded projected through the cap.

* * * * *